United States Patent [19]

Cestaro et al.

[11] Patent Number: 4,527,164

[45] Date of Patent: Jul. 2, 1985

[54] MULTIBAND AERIAL, ESPECIALLY SUITABLE FOR A MOTOR VEHICLE WINDOW

[75] Inventors: Massimo Cestaro, Vasto; Oscar De Lena, Termoli, both of Italy

[73] Assignee: Societa Italiana Vetro-SIV-S.p.A., Italy

[21] Appl. No.: 416,547

[22] Filed: Sep. 10, 1982

[30] Foreign Application Priority Data

Sep. 15, 1981 [IT] Italy ..... 23971 A/81

[51] Int. Cl.[3] ..... H01Q 1/32

[52] U.S. Cl. ..... 343/713

[58] Field of Search ..... 343/713, 722, 704

[56] References Cited

U.S. PATENT DOCUMENTS

| | | | |
|---|---|---|---|
| 3,599,214 | 8/1971 | Altmayer | 343/713 |
| 3,832,714 | 8/1974 | Cleminson et al. | 343/713 |
| 3,845,489 | 10/1974 | Sauer et al. | 343/713 |
| 4,063,247 | 12/1977 | Sakurai | 343/713 |
| 4,072,953 | 2/1978 | Comastri et al. | 343/713 |
| 4,072,954 | 2/1978 | Comastri et al. | 343/713 |
| 4,072,955 | 2/1978 | Comastri et al. | 343/713 |
| 4,090,202 | 5/1978 | Comastri et al. | 343/713 |
| 4,260,989 | 4/1981 | Ishii | 343/713 |

FOREIGN PATENT DOCUMENTS

| | | | |
|---|---|---|---|
| 960759 | 1/1975 | Canada | 343/713 |
| 2205755 | 5/1974 | France . | |

*Primary Examiner*—Eli Lieberman
*Assistant Examiner*—Karl Ohralik
*Attorney, Agent, or Firm*—McGlew and Tuttle

[57] ABSTRACT

A multiband aerial, especially suitable for a motor vehicle window, or for application to the window, which comprises a single conductor wire which starts from a signal pickup position, terminating in just the one free end, and which includes the FM aerial section and the AM aerial section, with such sections being connected in series, and therefore not requiring phasing, and being electrically isolated by means of an inductor, preferably of box rib pattern, which inductor can function as an open circuit in the FM band and as a short circuit in the AM band. The series of vertical and horizontal segments, forming the sole aerial conductor wire which contains in series such FM section and AM section, can be of variable, but always asymmetrical, geometry or configuration. The resultant multiband aerial can be optimized regarding reception capacity in the various cases, by simply varying the position of the signal pickup point to anywhere on the window, or else by varying the length of the sole aerial wire, or yet again by varying the distance of the wire from the edge of such window.

19 Claims, 7 Drawing Figures

RIPETITORE RAI
90°
180°
0°≡360°
270° dB
f=93,5 MHz
A
B
C
B'
C'
A
0°
90°
180°
270°
360° dB f=91,5 MHz
A
B
C
B'
C'
A
0°
90°
180°
270°
360° dB f=89,5 MHz
A
C
B
B'
C'
A
0°
90°
180°
270°
360°

MULTIBAND AERIAL, ESPECIALLY SUITABLE FOR A MOTOR VEHICLE WINDOW

FIELD AND BACKGROUND OF THE INVENTION

This invention relates to a multiband aerial, especially suitable for application to a motor vehicle window such as a front windshield or windscreen window.

The aerial assembly, or rather the aerial circuit, in accordance with the invention, and the window on which said circuit is applied, is usually just called the "aerial window".

Multiband aerials for reception of signals both in the ultrashort wave band (FM), and in the short, medium and long wave band (AM) are already well known in many and various configurations, and are increasingly finding general application, replacing the fishpole type aerials hitherto used on motor vehicles.

The circuits of said multiband aerials are generally applied on the window by means of a silk screen printing process on a glass frit containing a metallic conductor, followed by annealing, or else by the imbedding of a conductor wire in the plastic film interposed between two glass panes which form the window, and which window or window pane is operatively mounted in a corresponding motor vehicle window opening in conventional manner, e.g. as a windshield or windscreen window or window pane (see FIG. 5).

The hitherto known multiband aerial configurations normally consist of central elements on the windshield or windscreen window for FM reception, and side elements, going along the edge of the windshield or windscreen window, for AM reception; these elements are then interconnected to the cable leading from the aerial to the radio receiver.

Particularly widely diffused, among the various aerial configurations adopted, are those described in Italian Pat. No. 945.948 (to Saint Gobain) consisting of a vertical conductor of fishpole or T form for reception in the ultra short wave band (FM) arranged along the windshield or windscreen window centre line, and of a separate conductor for reception in the short, medium and long wave band branching from the signal pick up point into two arms which follow along the windshield or windscreen window edge.

Also worthy of note, thanks to its special characteristics, is the aerial configuration according to Italian patent application no. 20387 A/79 (to Fabbrica Pisana S.p.A.) consisting of vertical segments interconnected to horizontal segments, wherein the latter are chiefly confined to the top part of the windshield or windscreen window, and their horizontalness depends on the slope of the windshield or windscreen window top edge.

Lastly mention should be made of the aerial configuration, outstanding for its novelty, according to French patent application No. 7338052 (publication no. 2.205.755) (to Flachglas A.G. Delog-Detag). This aerial consists of double vertical and horizontal elements interconnected at the signal pickup point.

All hitherto known aerial configurations, including the above described ones, have the various conductors forming the aerial, that is for FM and for AM, converging on one or more points which are connected one to the other, and therefore "in parallel".

Hence in these known configurations, the signal received from the central aerial segment is then summed in phase with that received from the peripheral aerial segment, in order to improve aerial performance in AM or FM.

These already known aerial configurations however possess two rather appreciable drawbacks: firstly, it is not possible in actual practice to vary the signal pickup position on the window, while at the same time keeping the configuration geometry unvaried, as the conductor element lengths are interdependent on ratios which are in relation to the wave lengths received; secondly, all the aerial configurations hitherto described are highly directional.

This means that the aerial receives radio signals at an acceptable degree only when it is oriented towards the transmitter within certain angles, and its reception properties are considerably diminished when the angle of orientation is over 180° and below 360°.

SUMMARY OF THE INVENTION

The multiband aerial in accordance with the invention, remedies such drawbacks and represents appreciable progress in its particular industrial field by drastically reducing the directivity of reception; hence it is possible to alter the position of the signal pickup point without this impairiing reception properties. Consequently reception capability in the ultra-short wave band (FM) is appreciably increased.

The multiband aerial devised by way of the present invention accomplishes the above aspects because of its various novel features.

The main feature comprises the provision of a single conductor which commences from the signal pickup position and continues with a series of vertical and horizontal segments of variable, but always asymmetrical, geometry (for example, as represented in any one of the accompanying drawings), terminating in just the one free end.

Briefly speaking, the aerial in accordance with the invention is based on two aerials (for FM and AM) connected in series and electrically isolated by means of an inductor.

This inductor functions as an open circuit in the FM band and as a short circuit, instead, in the AM band; hence the entire wire of the circuit functions as just one single series aerial in the AM band.

The series connection differs from the parallel connection hitherto adopted, in that it does not require phasing between the two aerials, which would on one hand, cause a non-optimum utilization, and on the other hand, impair the directivity in the FM band.

DESCRIPTION OF THE PREFERRED EMBODIMENTS

In the accompanying drawings, which are given as an exemplification of the principles of the invention with no limitation.

Figure 3:
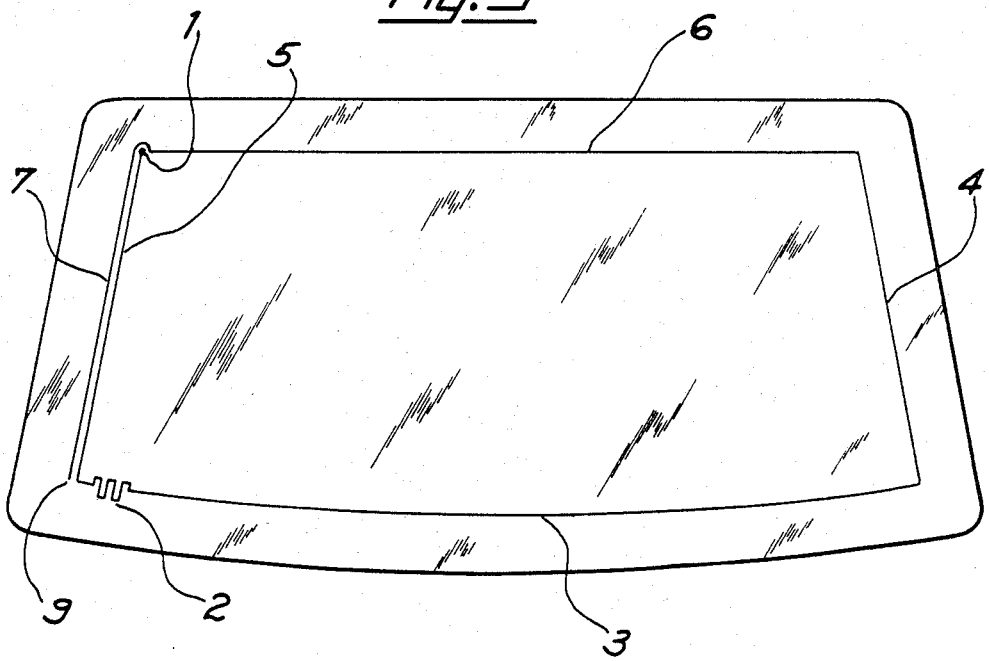
Figure 4:
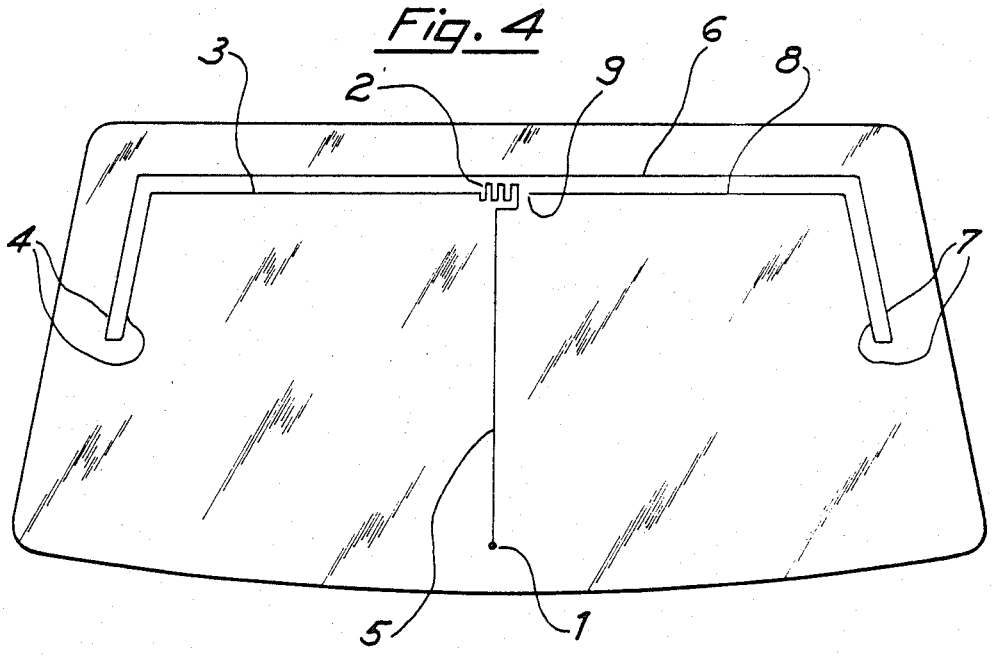
Figure 5:
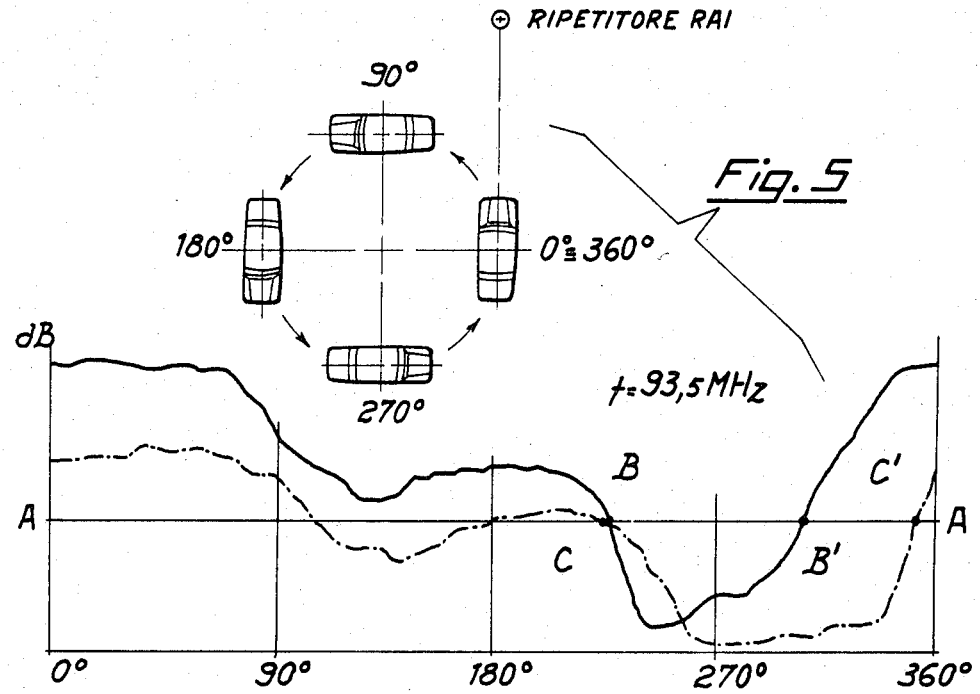
Figure 6:
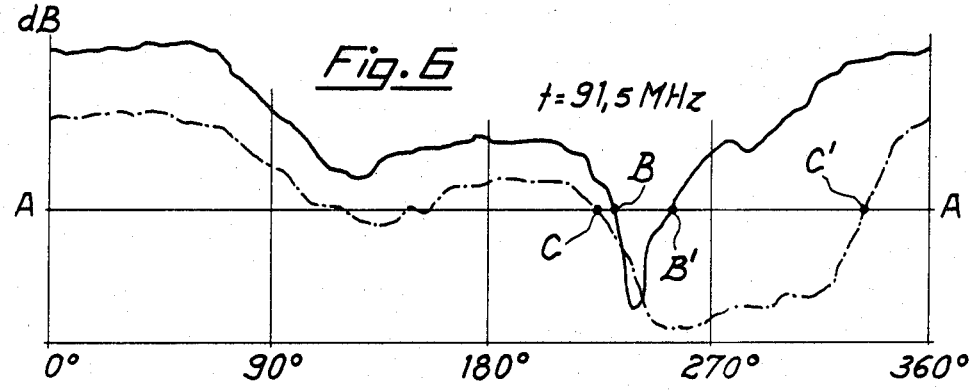
Figure 7:
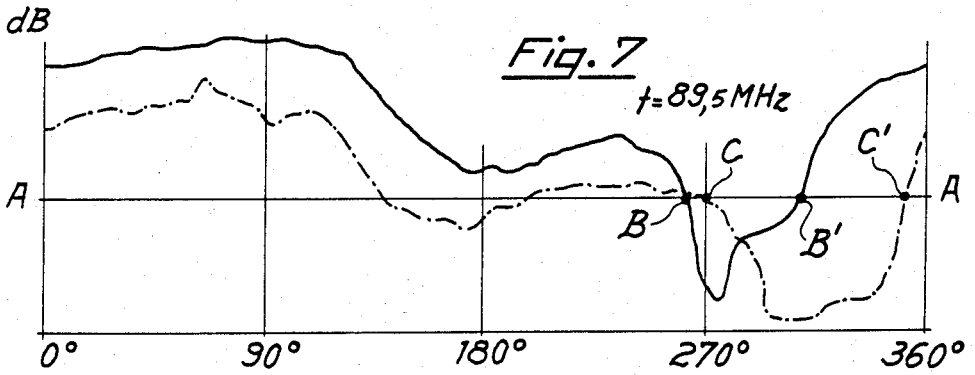

FIGS. 1, 2, 3, 4 show four different configurations on the window; these configurations consist of one single conductor in accordance with the invention, comprising the segments for FM reception and for AM reception respectively, which are connected in series and are electrically isolated by an inductor; while in FIGS. 5, 6, 7 a series of graphs are plotted, comparing—for the different frequencies—the degrees of reception obtainable with the aerial in accordance with the invention, with an already known aerial, and with the car being parked in various positions (FIG. 5).

As can be seen in the drawings (FIG. 1), a vertical aerial conductor 5 commences in upward direction from signal pickup point 1, lying on the windshield or windscreen window center line; the vertical aerial conductor 5 is connected in series to horizontal aerial conductor 3 by means of an inductor 2 of box rib pattern of crenelated pattern, whose dimensions are calculated in each individual case, in order to optimize the total length of the aerial elements for AM and FM reception.

The horizontal part of the aerial conductor continues in this configuration with vertical and horizontal sections 4,6,7,8, which are interconnected in series and terminate in one free end 9. Hence, as already emphasized, the aerial only has two ends: one for the signal pickup point 1; and the other being terminal end 9.

Figure 2:
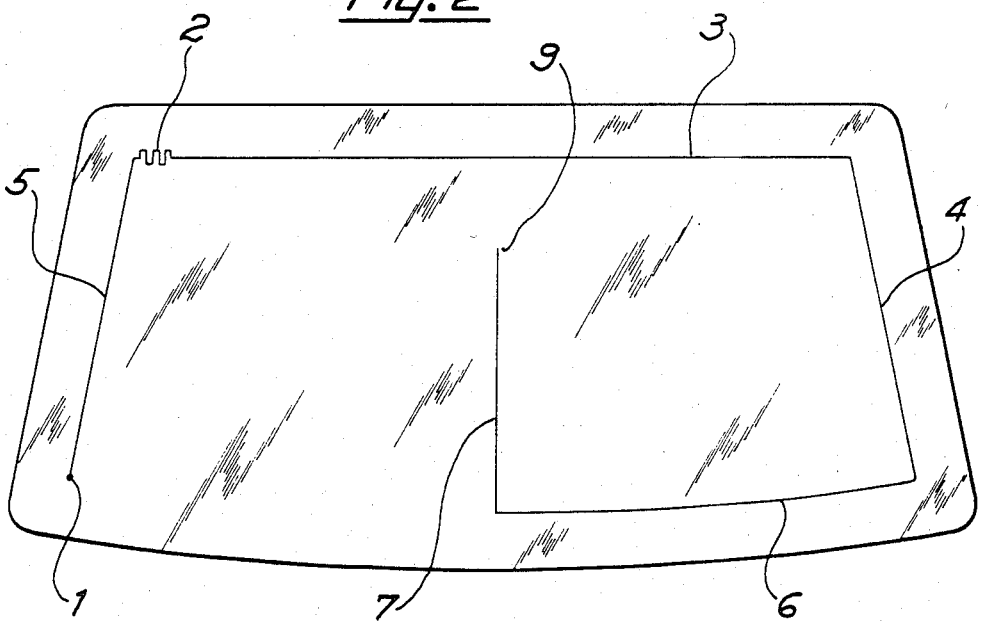

The position of the signal pickup point 1 can also be shifted but to a side zone, and the segments can follow one another, being connected in series, as in FIG. 2.

Moreover position of the signal pickup point 1 need not necessarily be at the bottom of the window as in the previous examples, but can be at top left; also in this case, all aerial elements are connected in series, as in FIG. 3.

Figure 1:
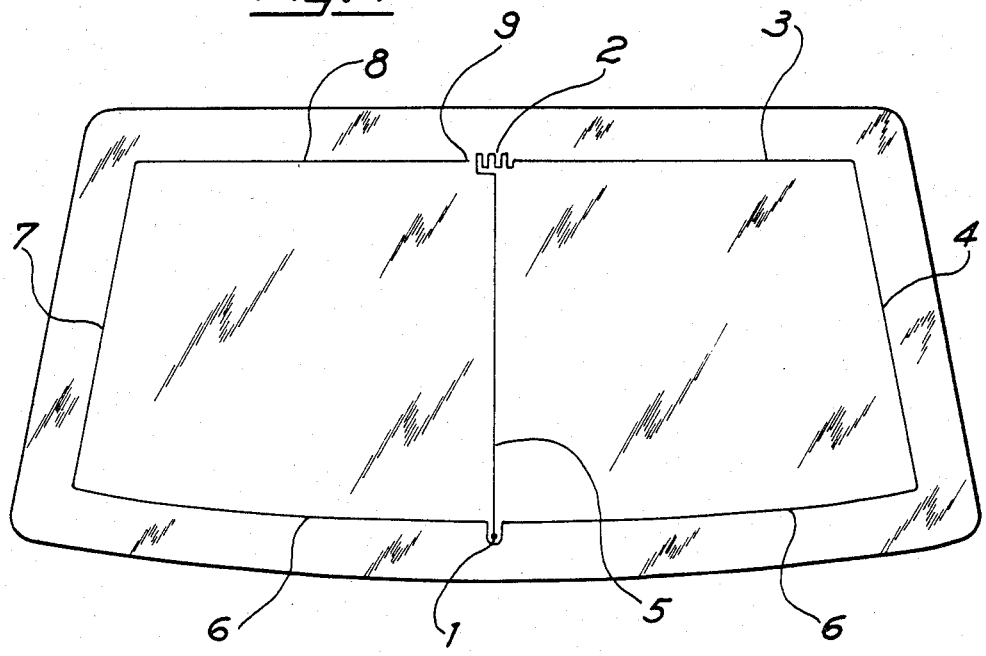

In the aerial configuration illustrated in FIG. 4, the signal pickup point is still located at the bottom towards the centre as in the example shown in FIG. 1, but all the other elements 2,3,4,5,6,7,8 are confined to the top part of the window and are connected in series, up to free end 9.

A number of experiments have been carried out according to the present invention which involved the mounting of a windshield or a windscreen incorporating an aerial circuit with a configuration in accordance with the invention, on a FIAT 132 car; in these experiments the car was driven along a closed loop path at constant speed for a distance of about 20 km from a RAI (Radio Televisione Italiana) transmitter. The graphs plotted in FIGS. 5, 6, 7 were obtained for frequencies of 93.5 MHz, 91.5 MHz and 89.5 MHz respectively.

In these graphs, the solid line represents reception with the windshield or windscreen aerial in accordance with the invention, while the broken line represents reception with a windshield or windscreen aerial of conventional configuration.

The graphs clearly show the improved reception power of the aerial in accordance with the invention, which is about 40 to 60% higher.

Furthermore, these graphs show the clear decrease in amplitude of the angle between which reception is appreciably lowered due to the directivity.

In fact, if a line of constant dB, corresponding to preset value A, is traced, it is found that the length of segments B—B′ is always shorter than the length of segments C—C′.

The graph in FIG. 5 shows how said length is reduced by about 40%; in FIG. 6 the reduction is even greater—about 80%; in FIG. 7 reduction is about 50%.

Hence it is proved that the aerial in accordance with the invention represents, as already stated, substantial technical progress in the field of hitherto known windshield or windscreen aerials, as it highly successfully overcomes the disadvantage in which reception is considerably reduced when the aerial forms angles of over 180° and below 360° with the transmitter.

In order to understand more clearly the scope and import of the invention and how to optimize the aerial, which is an object of the invention, the motorcar should be considered, electromagnetically speaking, to be a hollow metal body in communication with the outside through various openings, one of which is the opening for the windshield or windscreen window; also the car dimensions are very small with respect to the incident wave (hectometric waves). Hence it is justifiable to adopt a quasi-static line of reasoning when dealing with the problem.

The motor car can therefore be represented as a hollow metal body immersed in an electrical potential produced by the external field.

An electric charge is induced in the car and the car is then brought up to a spatially constant potential. In the openings, instead, there is spatial distribution of potential which can be calculated either numerically (method of moments) or analytically on simplified models of the system.

The wire 1-2-4-5-6-7 integrates this difference in potential and applies it to input terminal 1.

So a physical understanding of the phenomenon permits deduction of the most appropriate wire arrangement in order to maximize the voltage received.

However, in order to optimize the voltage transferred to the receiver, it is also necessary for the impedance at the aerial input, that is substantially the capacitance of wire 1-2-4-5-6-7, to be in relation to the capacitance of the cable connecting the aerial to the receiver.

This capacitance can be varied by varying the wire length and the distance of the wire from the windshield or windscreen window edge.

In this way, full optimization of the aerial will be achieved.

In particular, the vertical segment or section for reception in the ultra short wave band (FM) which commences from the signal pickup point can be equally well arranged either along the window center line or at varying distances from either side of the window to which the aerial is applied. In turn, the signal pickup point from which the single conductor wire forming the aerial commences can be either at the top or bottom of the window incorporating the aerial without this impairing the reception properties.

In the same way, the series of vertical and horizontal segments or sections of the aerial for reception in the short, medium and long wave band (AM) can be close to either the four edges of the window, or only close to three of said edges, or only to part of them, and confined either to the top or bottom part of the window, and can terminate either at the side or on the center line of the window, as required, via such one free end and preferably terminates close to the inductor.

Generally, therefore, the present invention especially concerns a multiband aerial window or pane assembly, such as for a motor vehicle, which comprises an aerial window having an aerial circuit formed of a single continuous conductor wire, commencing from a signal pickup point and terminating in a single free end, said window having generally horizontal top and bottom edge portions, generally vertical opposed side edge portions, and a generally vertical center line portion, said wire including an aerial section for FM and an aerial section for AM connected in series so as not to require phasing and being electrically isolated from each other by an inductor which is arranged to function in open circuit for the FM band and in short circuit for the AM band, said aerial sections including a series of corresponding generally vertical segments and generally horizontal segments which are arranged in a selective geometrically asymmetrical configuration for forming the aerial, and said segments including a corresponding vertical segment for reception in the FM ultra short wave band commencing from said signal pickup point and terminating at said inductor, and further including corresponding vertical and horizontal segments for reception in the AM short, medium and long wave band which are correspondingly perimetrically arranged closely adjacent to at least a part of at least some of said edge portions and which commence from said signal pickup point and terminate at said single free end of the wire and which operate when said inductor functions in short circuit.

The FM band segment may be arranged generally along said center line portion or adjacent to but at a selective distance from one of the side edge portions, and the signal pickup point may be arranged generally adjacent to one of the horizontal edge portions and correspondingly along said center line portion or adjacent to but at a selective spaced distance from said one side edge portion (cf. FIGS. 1 to 4).

The free end of the wire may terminate generally adjacent to one of the side edge portions or at the center line portion, and the inductor may be arranged at either of such locations such that the free end of the wire terminates closely adjacent to the inductor (cf. FIGS. 1 to 3).

The AM band segments may be correspondingly arranged closely adjacent to at least three of the four edge portions, or to at least one of them and to only a part of at least another of them adjacent to said at least one edge portion, or to only one of the horizontal edge portions and to the corresponding partial portions of the side edge portions adjacent to that one horizontal edge portion and remote from the other horizontal edge portion (cf. FIGS. 1 to 4).

By reason of the series connected FM section and AM section in the single conductor wire, forming the multiband aerial and extending from the signal pickup point to the single free end, and containing the intermediate, e.g. box ribbon pattern or crenelated pattern, inductor which electrically isolates the FM section and AM section and which inherently functions as an open circuit in the FM band and as a short circuit in the AM band, advantageously the series of vertical and horizontal segments of such wire, relative to the vertical and horizontal orientation of the window pane itself, may be selectively varied in length and location so long as the overall geometrical configuration thereof remains without any axis of symmetry, i.e. remains geometrically asymmetrical, whereby the reception capacity of the multiband aerial can be optimized selectively in each individual case by simply varying the position of the signal pickup point to anywhere on the window, or by similarly varying the length of the sole aerial wire (and in particular the dimensions of the box ribbon pattern inductor), or even by varying the corresponding distance of such wire from the peripheral edge of the window or pane, all without requiring phasing between the FM and AM band signals, and while enjoying a reduced directivity of reception.

Persons skilled in the art can easily deduce other and further variations of the aerial configurations herein described and illustrated without departing from the true spirit of the present invention which is covered by the following claims.

We claim:

1. Multiband aerial window assembly, such as for a motor vehicle, which comprises an aerial window having an aerial circuit formed of one single continuous conductor wire, commencing from a signal pickup point and terminating in a single free end, and including an aerial section for FM and an aerial section for AM, with said sections being connected in series so as not to require phasing and being electrically isolated from each other by an inductor which is arranged to function in open circuit for the FM band and in short circuit for the AM band, said one single continuous conductor wire being a continuous wire which includes a series of corresponding generally vertical segments and generally horizontal segments which are arranged in a geometrically asymmetrical configuration for forming the aerial.

2. Assembly according to claim 1, wherein the window has generally horizontal top and bottom edge portions, generally vertical opposed side edge portions, and a generally vertical center line portion, and said segments include a corresponding vertical segment for reception in the FM ultra short wave band commencing from said signal pickup point.

3. Assembly according to claim 2, wherein said FM band segment is arranged generally along said center line portion, and said signal pickup point is arranged at said center line portion and generally adjacent to one of said horizontal edge portions.

4. Assembly according to claim 2, wherein said FM band segment and signal pickup point are arranged generally adjacent to but at a selective distance from one of said side edge portions, and said signal pickup point is arranged generally adjacent to one of said horizontal edge portions.

5. Assembly according to claim 1, wherein the window has generally horizontal top and bottom edge portions, generally vertical opposed side edge portions, and a generally vertical center line portion, and said segments include substantially vertical segments and substantially horizontal segments for reception in the AM short, medium and long wave band which are correspondingly perimetrically arranged closely adjacent to at least a part of at least some of said edge portions and said AM band segments terminate at said single free end of the wire.

6. Assembly according to claim 5, wherein said free end of the wire terminates generally adjacent to one of said side edge portions.

7. Assembly according to claim 6, wherein the inductor is arranged generally adjacent to one of said side edge portions and the free end of the wire terminates closely adjacent to the inductor.

8. Assembly according to claim 5, wherein said free end of the wire terminates at said center line portion.

9. Assembly according to claim 8, wherein the inductor is arranged at said center line portion and the free end of the wire terminates closely adjacent to the inductor.

10. Assembly according to claim 5, wherein said AM band segments are correspondingly arranged closely adjacent to at least three of said edge portions.

11. Assembly according to claim 5, wherein said AM band segments are correspondingly arranged closely adjacent to at least one of said edge portions and to only part of at least another of said edge portions adjacent to said at least one edge portion.

12. Assembly according to claim 5, wherein said AM band segments are correspondingly arranged closely adjacent to only one of said horizontal edge portions and to the corresponding partial portions of said side edge portions which are adjacent to said only one horizontal edge portion and remote from the other said horizontal edge portion.

13. Assembly according to claim 1, wherein the inductor is provided with a box rib pattern of selectively calculated dimensions for optimizing the total length of the single conductor wire.

14. Assembly according to claim 1, wherein said assembly is operatively mounted in a motor vehicle window opening.

15. Multiband aerial window pane assembly, such as for a motor vehicle, which comprises an aerial window having an aerial circuit formed of a single continuous conductor wire, commencing from a signal pickup point and terminating in a single free end, said window having generally horizontal top and bottom edge portions, generally vertical opposed side edge portions, and a generally vertical center line portion, said wire including an aerial section for FM and an aerial section for AM connected in series so as not to require phasing and being electrically isolated from each other by an inductor which is arranged to function in open circuit for the FM band and in short circuit for the AM band, said aerial sections including a series of corresponding generally vertical segments and generally horizontal segments which are arranged in a selective geometrically asymmetrical configuration for forming the aerial, and said segments including a corresponding vertical segment for reception in the FM ultra short wave band commencing from said signal pickup point and terminating at said inductor, and further including corresponding vertical and horizontal segments for reception in the AM short, medium and long wave band which are correspondingly perimetrically arranged closely adjacent to at least a part of at least some of said edge portions and which commence from said signal pickup point and terminate at said single free end of the wire and which operate when said inductor functions in short circuit.

16. Assembly according to claim 15, wherein said FM band segment is arranged generally along said center line portion, and said signal pickup point is arranged at said center line portion and generally adjacent to one of said horizontal edge portions.

17. Assembly according to claim 15, wherein said FM band segment and signal pickup point are arranged generally adjacent to but at a selective distance from one of said side edge portions, and said signal pickup point is arranged generally adjacent to one of said horizontal edge portions.

18. Assembly according to claim 15, wherein said free end of the wire terminates closely adjacent to the inductor.

19. Assembly according to claim 15, wherein the inductor is provided with a box rib pattern of selectively calculated dimensions for optimizing the total length of the single conductor wire.

* * * * *